United States Patent [19]

Jaeckel et al.

[11] Patent Number: 4,883,495

[45] Date of Patent: Nov. 28, 1989

[54] AMINO-CONTAINING ALKENYLSUCCINIC ESTERS

[75] Inventors: Lothar Jaeckel, Flörsheim am Main; Rolf Kleber, Neu-Isenburg; Bernhard Mees, Eppstein, all of Fed. Rep. of Germany

[73] Assignee: Hoechst Aktiengesellschaft, Frankfurt am Main, Fed. Rep. of Germany

[21] Appl. No.: 247,277

[22] Filed: Sep. 21, 1988

[30] Foreign Application Priority Data

Sep. 25, 1987 [DE] Fed. Rep. of Germany ..... 3732340

[51] Int. Cl.[4] ..... D06M 9/00; C07C 69/593

[52] U.S. Cl. ..... 8/115.6; 8/115.51; 560/196; 560/204

[58] Field of Search ..... 560/196; 8/115.51, 115.6

[56] References Cited

U.S. PATENT DOCUMENTS

| | | | |
|---|---|---|---|
| 4,185,485 | 1/1980 | Shick et al. | 560/196 X |
| 4,435,297 | 3/1984 | Forsberg | 560/196 X |
| 4,734,523 | 3/1988 | Hofinger et al. | 560/196 |

*Primary Examiner*—Werren B. Lone
*Assistant Examiner*—Vera C. Clarke

[57] ABSTRACT

Amino-containing alkenylsuccinic esters of the formulae

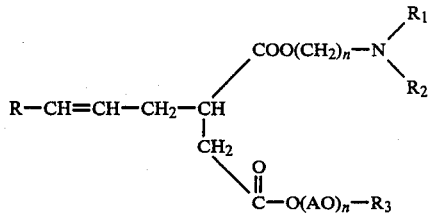

and

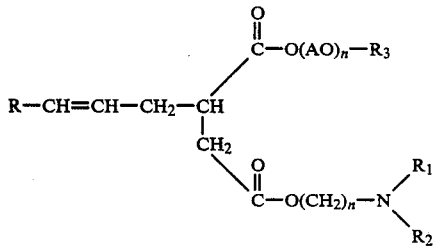

where R denotes linear or branched $C_1$–$C_{20}$-alkyl, $R_1$ denotes hydroxy-$C_2$–$C_6$-alkyl or $C_1$–$C_4$-alkyl, $R_2$ denotes methyl or ethyl, $R_3$ denotes $C_6$–$C_{20}$-alkyl, preferably $C_{12}$–$C_{18}$-alkyl, or $C_6$–$C_{20}$-alkenyl, preferably $C_{12}$–$C_{18}$-alkenyl, A denotes —$C_2H_4$— or $C_3H_7$— and n denotes a number from 1 to 10, preferably from 3 to 8, the preparation thereof and the use thereof as thermostable lubricants in spin finishes.

9 Claims, No Drawings

AMINO-CONTAINING ALKENYLSUCCINIC ESTERS

DESCRIPTION

In the production of synthetic fibers it is absolutely necessary to apply spin finishes to the fiber surface. These spin finishes have the function, in the main, of minimizing yarn/metal friction but also of adjusting filament/filament friction and of preventing electrostatic charge buildup. In the texturing of polyester filament yarns, for example, the filaments are passed at high speed through a spindle and then through heating zones in order to set the bulk. However, at the high temperatures (above 200° C.), spin finishes are thermally decomposed or sublime away, become deposited on the heater elements and are cracked to form solid black residues which interfere noticeably with the continued texturing process. For this reason the machines must be switched off at regular intervals and the residues cleaned mechanically off the heating units, thereby not only incurring expense but also possible endangering the health of the cleaning personnel. There is therefore a long-felt need for thermostable lubricants which leave on the heating elements only liquid residues which are emulsible with water and thus easily removable.

Similar problems with decomposition products of spin finishes exist on production lines for the production of industrial yarns (tire cords, conveyor belts).

It has now been found that the amino-containing alkenylsuccinic esters described hereinafter are suitable for use as fiber finishes and are notable for improved thermostability.

The present invention thus provides amino-containing alkenylsuccinic esters of the formulae

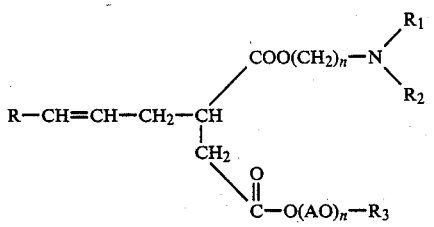

and

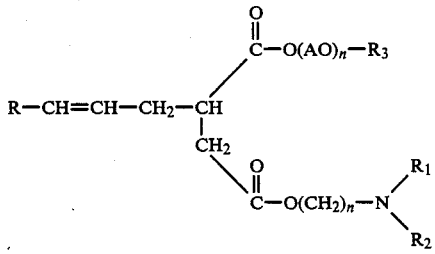

where R denotes linear or branched $C_1$–$C_{20}$-alkyl, preferably $C_5$–$C_{15}$-alkyl, $R_1$ denotes hydroxy-$C_2$–$C_6$-alkyl or $C_1$–$C_4$-alkyl, $R_2$ denotes methyl or ethyl, $R_3$ denotes $C_6$–$C_{20}$-alkyl, preferably $C_{12}$–$C_{18}$-alkyl, or $C_6$–$C_{20}$-alkenyl, preferably $C_{12}$–$C_{18}$-alkenyl, A denotes $—C_2H_4—$ or $—C_3H_7—$ and n denotes a number from 1 to 10, preferably from 3 to 8.

These compounds are prepared by first reacting alkenylsuccinic acids of the formula

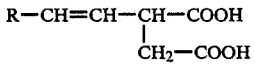

or preferably hydrides thereof with approximately one mole of an amine of the formula

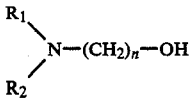

and then reacting the resulting alkenylsuccinic monoester with approximately one mole of an alkoxylated alcohol of the formula $$R_3(OH)_n—OH.$$

Alkenylsuccinic anhydrides are obtained by reacting α-olefins with maleic anhydride at temperatures around 200° C. For this reaction it is possible to use linear or branched olefins, such as tripropylene (i-nonene) or tetrapropylene (i-dodecene). The alkoxylated fatty alcohols are prepared in a conventional manner by addition of ethylene oxide or propylene oxide onto the parent alcohols.

The reaction of alkenylsuccinic anhydrides with aliphatic amino compounds takes place at temperatures of 20° to 120° C., preferably at 60° to 100° C. The 2nd stage, i.e. the esterification of the free carboxyl group with the fatty alcohol ethoxylate, is carried out at temperatures of 140° to 260° C., preferably at temperatures of 160° to 200° C., by acid catalysis. The acids used for this purpose can be inorganic compounds such as sulfuric acid, phosphoric acid, phosphorous acid, etc., or organic acids such as p-toluenesulfonic acid or acidic ion exchangers. The amounts required for this purpose depend on the type of acid, ranging from 0.1 to 3% by weight, preferably from 0.5 to 1.5% by weight. The water of reaction is separated off by distillation until an acid number below 10 is obtained. The two stages of the reaction can be carried out not only in the presence but also in the absence of a solvent. Suitable solvents here are inert organic solvents of high boiling point, for example decalin or chlorinated aromatic hydrocarbons.

The alkenylsuccinic esters according to the invention are used as spin finish components for the spin finishing of fibers made of polyester, polyamide, polyacrylonitrile or polyolefins and aramid fibers. They can be used in place of the customary lubricants, for example mineral oils or ester oils, for example hexadecyl stearate and others, in combination with emulsifiers based on ethoxylated fatty alcohols or in conjunction with antistats and yarn cohesion agents. The proportion thereof in the filament spin finishes can range from 90 to 10%, preferably from 60 to 30%. The spin finish add-on on the fiber ranges in general from 0.1 to 2%, preferably from 0.3 to 1.2% by weight.

These alkenylsuccinic esters have the advantage that they are thremostable and that the residues of these compounds are liquid under the conditions under which they are used in textile fiber production and thus are easily removable.

The Examples which follow are intended to illustrate the invention without limiting it.

EXAMPLE 1

In a 250 ml vessel equipped with stirrer, internal thermometer and short path distillation attachment, 53.38 parts by weight of n-dodecenylsuccinic anhydride are melted at about 50° C., and 18 parts by weight of N,N-dimethylethanolamine are added dropwise with stirring under nitrogen at 50° to 55° C. in the course of 30 minutes. The thick emulsion is stirred at 50° C. for 4.5 hours until anhydride is no longer detectable by thin layer chromatography. The mixture is cooled down to 30° C., and 86.3 parts by weight of a coconut alcohol ethoxylate (incorporating 5 ethylene oxide units), 1.2 parts by weight of ultrapure boric acid and 1.7 parts by weight of hypophosphorous acid (50% strength) are added. This is followed by 4 hours of stirring at 150°–155° C. under nitrogen, during which a total of 4 ml of water are distilled off. This is followed by distillation under reduced pressure at a temperature between 130° to 155° C. for 3 hours to remove in addition 8 parts by weight of the starting compound, leaving 146 parts by weight of a pale brown, pourable compound having a pH (1% in water) of 6 to 7.

EXAMPLE 2

Example 1 is repeated, except that n-dodecenylsuccinic anhydride is replaced by 50 g of i-nonenylsuccinic anhydride. About 45 g of a pale brown liquid having a pH of 7 are obtained.

EXAMPLE 3

In a 500 ml vessel equipped with stirrer, internal thermometer and short path distillation attachment, 70 parts by weight of n-octadecenylsuccinic anhydride are dissolved in 150 parts by volume of tetralin, and 21.6 parts by weight of N,N-diethylethanolamine are added dropwise with stirring under nitrogen at 35° C. in the course of 30 minutes. The mixture is left to react at 50° C. for 4 hours and then cooled down to room temperature, and 107 parts by weight of stearyl alcohol with 6 moles of ethylene oxide and 3 parts by weight of p-toluenesulfonic acid are added. About 4 ml of water are distilled off at 160° to 180° C. in the course of 2 hours, and then the tetralin is distilled off at 160° C. in an aspirator vacuum and recovered. About 190 parts by weight are obtained of a pale brown, viscous oil having a pH of 7.

EXAMPLE 4

Example 2 is repeated, except that the 21.6 parts by weight of N,N-diethylethanolamine are replaced by 25 parts by weight of N,N-dimethylbutanolamine. About 193 parts by weight are obtained of a pale brown, viscous oil having a pH of 7.

The compounds obtained according to Examples 1 to 4 have the following structures:

1. $C_9H_{19}-CH=CH-CH_2-\underset{\underset{CH_2-COO(C_2H_4O)_5-R}{|}}{CH}-COO(CH_2)_2-N(CH_3)_2$ and $$C_9H_{19}-CH=CH-CH_2-\overset{\overset{CH_2-COO(CH_2)_2-N(CH_3)_2}{|}}{CH}-COO(C_2H_4O)_5-R$$

R = cocoalkyl

-continued

2. $C_6H_{13}-CH=CH-CH_2-\underset{\underset{CH_2-COO(C_2H_4O)_5-R}{|}}{CH}-COO(CH_2)_2-N(CH_3)_2$ and $$C_6H_{13}-CH=CH-CH_2-\overset{\overset{CH_2-COO(CH_2)_2-N(CH_3)_2}{|}}{CH}-COO(C_2H_4O)_5-R$$

R = cocoalkyl

3. $C_{15}H_{31}-CH=CH-CH_2-\underset{\underset{CH_2-COO(C_2H_4O)_6-R}{|}}{CH}-COO(CH_2)_2-N(C_2H_5)_2$ and $$C_{15}H_{13}-CH=CH-CH_2-\overset{\overset{CH_2-COO(CH_2)_2-N(C_2H_5)_2}{|}}{CH}-COO(C_2H_4O)_6-R$$

R = stearyl

4. $C_6H_{13}-CH=CH-CH_2-\underset{\underset{CH_2-COO(C_2H_4O)_5-R}{|}}{CH}-COO(CH_2)_4-N(CH_3)_2$ and $$C_6H_{13}-CH=CH-CH_2-\overset{\overset{CH_2-COO(CH_2)_4-N(CH_3)_2}{|}}{CH}-COO(C_2H_4O)_5-R$$

R = cocoalkyl

EXAMPLE 5

Heating test: 1 g samples of the following substances are weighed out into a thin aluminum dish which is heated at 220° C. for 24 hours and the losses determined:

(a) mineral oil (viscosity at 20° C. : 300 mPas)
(b) pentaerythritol tetradecylate
(c) product according to Example 1
(d) product according to Example 2
(e) product according to Example 3
(f) product according to Example 4
a+b: comparisons
c–f: according to the invention

| | Loss at 220° C./24 h | Residue | Solubility of residue in cold water |
|---|---|---|---|
| (a) | 50% | black, solid | insoluble |
| (b) | 60% | black, solid | insoluble |
| (c) | 33% | yellow, greasy | emulsible |
| (d) | 40% | yellow, greasy | emulsible |
| (e) | 35% | yellow, greasy | emulsible |
| (f) | 30% | yellow, greasy | emulsible |

EXAMPLE 6

Friction values on PES

| Product | Pure oil | | 5 g/l | |
|---|---|---|---|---|
| | static | dynamic | static | dynamic |
| a | 8.4 | 0.44–0.48 | 8.2 | 0.49–0.50 |
| b | 8.5 | 0.48–0.59 | 8.3 | 0.49–0.55 |
| c | 8.9 | 0.42–0.47 | 8.0 | 0.43–0.47 |
| d | 8.3 | 0.44–0.48 | 8.1 | 0.44–0.49 |
| e | 8.2 | 0.41–0.46 | 8.0 | 0.40–0.45 |
| f | 8.2 | 0.43–0.49 | 8.1 | 0.41–0.46 |

a + b comparisons as per Example 5
c – f Examples 1 to 4 according to the invention These values were determined by the method specified in German Offenlegungsschrift 2,355,675, specifically at measuring speeds of 25 m/min (first value) and 100 m/min (second value).

We claim:

1. A compound of the formulae

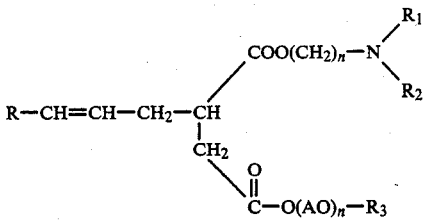

or

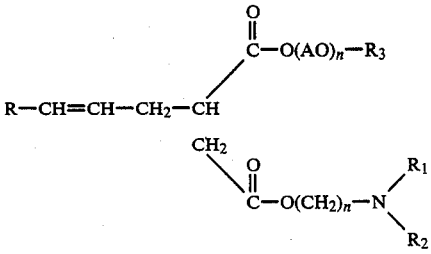

where R denotes linear or branched $C_1$–$C_{20}$-alkyl, $R_1$ denotes hydroxy-$C_2$–$C_6$-alkyl or $C_1$–$C_4$-alkyl, $R_2$ denotes methyl or ethyl, $R_3$ denotes $C_6$–$C_{20}$-alkyl, or $C_6$–$C_{20}$-alkenyl, A denotes —$C_2H_4$— or —$C_3H_7$— and n denotes a number from 1 to 10.

2. A process for preparing a compound as claimed in claim 1, which comprises reacting an alkenylsuccinic acid of the formula

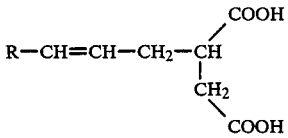

or the anhydride thereof first with 1 mole of an amine of the formula

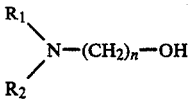

and then with 1 mole of an alkoxylated alcohol of the formula $R_3(OA)_n$—OH where R, $R_1$, $R_2$, $R_3$, A and n are as defined in claim 1.

3. A compound as claimed in claim 1, wherein:
R denotes linear or branched $C_5$–$C_{15}$ alkyl;
$R_3$ denotes $C_{12}$–$C_{18}$-alkyl or $C_{12}$–$C_{18}$-alkenyl; and
n denotes a number from 3 to 8.

4. A compound as claimed in claim 1, wherein R denotes linear or branched $C_5$–$C_{15}$ alkyl.

5. A compound as claimed in claim 1, wherein $R_3$ denotes $C_{12}$–$C_{18}$-alkyl.

6. A compound as claimed in claim 1, wherein $R_3$ denotes $C_{12}$–$C_{18}$ alkenyl.

7. A compound as claimed in claim 1, wherein n denotes a number from 3 to 8.

8. A compound as claimed in claim 5, wherein n denotes a number from 3 to 8.

9. A spin-finish composition containing an effective amount of a compound of claim 1 and at least one additional spin-finish component.

* * * * *